US006458749B2

(12) United States Patent
Kinker et al.

(10) Patent No.: US 6,458,749 B2
(45) Date of Patent: Oct. 1, 2002

(54) METHOD FOR IMPROVING LOW-TEMPERATURE FLUIDITY OF LUBRICATING OILS USING HIGH-AND-LOW-MOLECULAR WEIGHT POLYMER

(75) Inventors: Bernard G. Kinker, Kintnersville, PA (US); Thomas A. Mc Gregor, Trevose, PA (US); Joan Marie Souchik, Norristown, PA (US)

(73) Assignee: Rohmax Additives GmbH, Darmstadt (DE)

( * ) Notice: Subject to any disclaimer, the term of this patent is extended or adjusted under 35 U.S.C. 154(b) by 0 days.

(21) Appl. No.: 09/900,029

(22) Filed: Jul. 9, 2001

Related U.S. Application Data

(63) Continuation of application No. 09/136,731, filed on Aug. 19, 1998.

(60) Provisional application No. 60/056,898, filed on Aug. 22, 1997.

(51) Int. Cl.[7] ..... C10M 145/14

(52) U.S. Cl. ..... 508/469; 508/470

(58) Field of Search ..... 508/469, 470

(56) References Cited

U.S. PATENT DOCUMENTS

| | | | |
|---|---|---|---|
| 3,607,749 | A | 9/1971 | Forbes |
| 4,839,074 | A | 6/1989 | Rossi et al. |
| 4,867,894 | A | 9/1989 | Pennewiss et al. |
| 5,149,452 | A | 9/1992 | MacAlpine et al. |
| 5,281,329 | A | 1/1994 | Mueller et al. |
| 5,520,832 | A | 5/1996 | Alexander |
| 5,807,815 | A | 9/1998 | Alexander |
| 5,888,946 | A | 3/1999 | Zakarian et al. |

FOREIGN PATENT DOCUMENTS

| | | |
|---|---|---|
| EP | 140274 | 5/1995 |
| GB | 1559952 | 1/1980 |

OTHER PUBLICATIONS

Translation B. Zhao in "Depression Effect of Mixed Pour Point Depressants for Crude Oil", *J. Shenyang, Inst. Chem. Tech.*, 8(3), 228–230(1994).

*Primary Examiner*—Jacqueline V. Howard
(74) *Attorney, Agent, or Firm*—Oblon, Spivak, McClelland, Maier & Neustadt, P.C.

(57) ABSTRACT

A method for improving the low temperature fluidity of lubricating oil compositions based on addition to lubricating oils of a mixture of selected high molecular weight and low molecular weight alkyl (meth)acrylate copolymers is disclosed. Combinations of low molecular weight alkyl (meth) acrylate polymers containing zero to 25 weight percent ($C_{16}$–$C_{24}$)alkyl (meth)acrylate with high molecular weight alkyl (meth)acrylate polymers containing 25 to 70 weight percent ($C_{16}$–$C_{24}$)alkyl (meth)acrylate are especially effective at satisfying different aspects of low temperature fluidity properties simultaneously for a broad range of base oils.

9 Claims, No Drawings

METHOD FOR IMPROVING LOW-TEMPERATURE FLUIDITY OF LUBRICATING OILS USING HIGH-AND-LOW-MOLECULAR WEIGHT POLYMER

This is a continuation of application Ser. No. 09/136,731, filed Aug. 19, 1998, and claims the benefit of provisional application No. 60/056,898, filed Aug. 22, 1997.

BACKGROUND

This invention involves a method for improving overall low temperature fluidity properties of a broad range of lubricating oil compositions based on the addition of mixtures of selected high molecular weight and low molecular weight polymer additives, in particular alkyl (meth)acrylate polymer additives.

The behavior of petroleum oil formulations under cold flow conditions is greatly influenced by the presence of paraffins (waxy materials) that crystallize out of the oil upon cooling; these paraffins significantly reduce the fluidity of the oils at low temperature conditions. Polymeric flow improvers, known as pour point depressants, have been developed to effectively reduce the "pour point" or solidifying point of oils under specified conditions (that is, the lowest temperature at which the formulated oil remains fluid). Pour point depressants are effective at very low concentrations, for example, between 0.05 and 1 percent by weight in the oil. It is believed that the pour point depressant material incorporates itself into the growing paraffin crystal structure, effectively hindering further growth of the crystals and the formation of extended crystal agglomerates, thus allowing the oil to remain fluid at lower temperatures than otherwise would be possible.

One limitation of the use of pour point depressant polymers is that petroleum base oils from different sources contain varying types of waxy or paraffin materials and not all polymeric pour point depressants are equally effective in reducing the pour point of different petroleum oils, that is, a polymeric pour point depressant may be effective for one type of oil and ineffective for another. As existing oil fields become depleted, lower grade oil reservoirs are being used resulting in the supply of base oils (or base stocks) having an overall lower quality than previously encountered; these base oils are more difficult to handle, thus making it more difficult for conventional pour point depressant polymers to satisfy the multiple low temperature requirements of lubricating oil compositions derived from a wide variety of base oils.

One approach to solving this problem is disclosed in "Depression Effect of Mixed Pour Point Depressants for Crude Oil" by B. Zhao, *J. Shenyang, Inst. Chem. Tech.,* 8(3), 228–230 (1994), where improved pour point performance on two different crude oil samples was obtained by using a physical mixture of two different conventional pour point depressants when compared to using the pour point depressants individually in the oils. Similarly, U.S. Pat. No. 5,281,329 and European Patent Application EP 140,274 disclose the use of physical mixtures of different polymeric additives to achieve improved pour point properties when compared to using each polymer additive alone in lubricating oils. U.S. Pat. No. 5,149,452 discloses combinations of low and high molecular weight polyalkylmethacrylates useful for reducing the pour points of wax isomerates compared to using the low or high molecular weight polyalkylmethacrylates alone. GB Patent No. 1559952 discloses combinations of viscosity index (VI) improving polyalkyl (meth)acrylates having greater than 75% ($C_{12}$–$C_{15}$)alkyl (meth)acrylate units with pour point depressing polyalkyl (meth)acrylates having less than 75% ($C_{12}$–$C_{15}$)alkyl (meth) acrylate units and 10–90% ($C_{16}$+)alkyl (meth)acrylate units; the polymer combinations were useful for reducing the pour points of hydrocracked lubricating oils compared to using each type of polyalkyl(meth)acrylate alone.

A 37/63 weight ratio mixture of poly(65 dodecyl-pentadecyl methacrylate/35 cetyl-stearyl methacrylate) having weight average molecular weight of approximately 500,000 and poly(85 dodecyl-pentadecyl methacrylate/15 cetyl-eicosyl methacrylate) having weight average molecular weight of approximately 100,000 was a commercially available pour point depressant additive formulation; the polymers were prepared by conventional solution polymerization processes.

It would be desirable for a pour point depressant polymer or mixture of pour depressant polymers to be useful in a wide variety of petroleum oils and also simultaneously satisfy more than one aspect of low temperature fluidity requirements, that is, other than pour point depression. Recent advances in measuring low temperature properties of oils have led to the need to satisfy multiple performance requirements, for example, low-shear rate viscosity, yield stress and gel index (used to predict low temperature pumpability in equipment), in addition to conventional pour point depression.

None of these previous approaches provides good low temperature fluidity when a polymer additive or combination of additives is used in a wide range of lubricating oil formulations. It is an object of the present invention to provide an improved method for treating a broad range of lubricating oils such that different aspects of low temperature fluidity are satisfied simultaneously.

SUMMARY OF INVENTION

The present invention provides a method for maintaining low temperature fluidity of a lubricating oil composition comprising adding from 0.03 to 3 percent, based on total lubricating oil composition weight, of a first [$P_1$] and a second [$P_2$] polymer to the lubricating oil composition wherein (a) the first polymer [$P_1$] comprises zero to 15 percent monomer units selected from one or more ($C_1$–$C_6$) alkyl (meth)acrylates, 30 to 75 percent monomer units selected from one or more ($C_7$–$C_{15}$)alkyl (meth)acrylates and 25 to 70 percent monomer units selected from one or more ($C_{16}$–$C_{24}$)alkyl (meth)acrylates, based on total first polymer weight, and has a weight average molecular weight from 250,000 to 1,500,000; (b) the second polymer [$P_2$] comprises zero to 15 percent monomer units selected from one or more ($C_1$–$C_6$)alkyl (meth)acrylates, 75 to 100 percent monomer units selected from one or more ($C_7$–$C_{15}$)alkyl (meth)acrylates and zero to 25 percent monomer units selected from one or more ($C_{16}$–$C_{24}$)alkyl (meth)acrylates, based on total second polymer weight, and has a weight average molecular weight from 10,000 to 1,500,000; (c) the first polymer [$P_1$] has a weight average molecular weight at least 50,000 greater than that of the second polymer [$P_2$]; and (d) the first and second polymers are combined in a weight ratio ([$P_1$]/[$P_2$]) of 5/95 to 75/25.

In another embodiment the present invention provides a method for maintaining low temperature fluidity of a lubricating oil composition wherein the first [$P_1$] and second [$P_2$] polymers are selected and combined in a weight ratio such that the lubricating oil composition has (a) a "gel index" of less than 12, and (b) a "low-shear rate viscosity" of less than 60 pascal·seconds with a "yield stress" of less than 35 pascals.

In another aspect the present invention provides concentrate and lubricating oil compositions comprising the first $[P_1]$ polymer described above and a second $[P_2]$ polymer, wherein the second polymer $[P_2]$ comprises zero to 15 percent monomer units selected from one or more $(C_1–C_6)$ alkyl (meth)acrylates, 90 to 100 percent monomer units selected from one or more $(C_7–C_{15})$alkyl (meth)acrylates and zero to 10 percent monomer units selected from one or more $(C_6–C_{24})$alkyl (meth)acrylates, based on total second polymer weight, and has a weight average molecular weight from 10,000 to 1,500,000; the first polymer $[P_1]$ has a weight average molecular weight at least 50,000 greater than that of the second polymer $[P_2]$; and the first and second polymers are combined in a weight ratio $([P_1]/[P_2])$ of 5/95 to 75/25.

DETAILED DESCRIPTION

The process of the present invention is useful for improving different aspects of low temperature fluidity simultaneously for a broad range of lubricating oils. We have found that combinations of selected low and high molecular weight polymers are effective for this purpose and result in unexpectedly improved low temperature fluidity performance of lubricating oils as compared with the use of prior art polymer additives and combinations of additives.

We have discovered a method for maintaining low temperature fluidity of a lubricating oil composition comprising adding from 0.03 to 3 percent, based on total lubricating oil composition weight, of a first $[P_1]$ and a second $[P_2]$ polymer to the lubricating oil composition wherein the first polymer $[P_1]$ comprises monomer units selected from one or more of vinylaromatic monomers, α-olefins, vinyl alcohol esters, (meth)acrylic acid derivatives, maleic acid derivatives and fumaric acid derivatives, and has a weight average molecular weight from 250,000 to 1,500,000; the second polymer $[P_2]$ comprises monomer units selected from one or more of vinylaromatic monomers, α-olefins, vinyl alcohol esters, (meth)acrylic acid derivatives, maleic acid derivatives and fumaric acid derivatives, and has a weight average molecular weight from 10,000 to 1,500,000; the first polymer $[P_1]$ has a weight average molecular weight at least 50,000 greater than that of the second polymer $[P_2]$; and the first and second polymers are combined in a weight ratio $([P_1]/[P_2])$ of 5/95 to 75/25. Preferably, the first $[P_1]$ and second $[P_2]$ polymer additives are based on monomeric units of (meth) acrylic acid derivatives.

As used herein, the term "(meth)acrylic" refers to either the corresponding acrylic or methacrylic acid and derivatives; similarly, the term "alkyl (meth)acrylate" refers to either the corresponding acrylate or methacrylate ester. As used herein, all percentages referred to will be expressed in weight percent (%), based on total weight of polymer or composition involved, unless specified otherwise. As used herein, the term "copolymer" or "copolymer material" refers to polymer compositions containing units of two or more monomers or monomer types. As used herein, "monomer type" refers to those monomers that represent mixtures of individual closely related monomers, for example, LMA (mixture of lauryl and myristyl methacrylates), DPMA (a mixture of dodecyl, tridecyl, tetradecyl and pentadecyl methacrylates), SMA (mixture of hexadecyl and octadecyl methacrylates), CEMA (mixture of hexadecyl, octadecyl and eicosyl methacrylates). For the purposes of the present invention, each of these mixtures represents a single monomer or "monomer type" when describing monomer ratios and copolymer compositions.

Monomers used in polymers useful in the process of the present invention may be any monomers capable of polymerizing with comonomers; preferably the monomers are monoethylenically unsaturated monomers. Polyethylenically unsaturated monomers which lead to crosslinking during the polymerization are generally undesirable; polyethylenically unsaturated monomers which do not lead to crosslinking or only crosslink to a small degree, for example, butadiene, are also satisfactory comonomers.

One class of suitable monoethylenically unsaturated monomers is vinylaromatic monomers that includes, for example, styrene, α-methylstyrene, vinyltoluene, ortho-, meta- and para-methylstyrene, ethylvinylbenzene, vinylnaphthalene and vinylxylenes. The vinylaromatic monomers can also include their corresponding substituted counterparts, for example, halogenated derivatives, that is, containing one or more halogen groups, such as fluorine, chlorine or bromine; and nitro, cyano, alkoxy, haloalkyl, carbalkoxy, carboxy, amino and alkylamino derivatives.

Another class of suitable monoethylenically unsaturated monomers is ethylene and substituted ethylene monomers, for example: α-olefins such as propylene, isobutylene and long chain alkyl α-olefins (such as $(C_{10}–C_{20})$alkyl α-olefins); vinyl alcohol esters such as vinyl acetate and vinyl stearate; (meth)acrylic acid and derivatives such as corresponding amides and esters; maleic acid and derivatives such as corresponding anhydride, amides and esters; fumaric acid and derivatives such as corresponding amides and esters; itaconic and citraconic acids and derivatives such as corresponding anhydrides, amides and esters.

Suitable polymers useful as the first $[P_1]$ or second $[P_2]$ polymers in the process of the present invention include, for example, vinylaromatic polymers (such as alkylated styrene), vinylaromatic-(meth)acrylic acid derivative copolymers (such as styrene/acrylate ester), vinylaromatic-maleic acid derivative copolymers (such as styrene/maleic anhydride ester), vinyl alcohol ester-fumaric acid derivative copolymers (such as vinyl acetate/fumarate ester), α-olefin-vinyl alcohol ester copolymers (such as ethylene/vinyl acetate), α-olefin-maleic acid derivative copolymers (such as α-olefin/maleic anhydride ester), α-olefin-fumaric acid derivative copolymers (such as (α-olefin/fumarate ester) and (meth)acrylic acid derivative copolymers (such as acrylate and methacrylate esters).

A preferred class of (meth)acrylic acid derivatives is represented by alkyl (meth)acrylate, substituted (meth) acrylate and substituted (meth)acrylamide monomers. Each of the monomers can be a single monomer or a mixture having different numbers of carbon atoms in the alkyl portion. Preferably, the monomers are selected from the group consisting of $(C_1–C_{24})$alkyl (meth)acrylates, hydroxy $(C_2–C_6)$alkyl (meth)acrylates, dialkylamino$(C_2–C_6)$alkyl (meth)acrylates and dialkylamino$(C_2–C_6)$alkyl (meth) acrylamides. The alkyl portion of each monomer can be linear or branched.

Particularly preferred polymers useful in the process of the present invention are the polyalkyl(meth)acrylates derived from the polymerization of alkyl (meth)acrylate monomers. Examples of the alkyl (meth)acrylate monomer where the alkyl group contains from 1 to 6 carbon atoms (also called the "low-cut" alkyl (meth)acrylates), are methyl methacrylate (MMA), methyl and ethyl acrylate, propyl methacrylate, butyl methacrylate (BMA) and acrylate (BA), isobutyl methacrylate (IBMA), hexyl and cyclohexyl methacrylate, cyclohexyl acrylate and combinations thereof.

Examples of the alkyl (meth)acrylate monomer where the alkyl group contains from 7 to 15 carbon atoms (also called the "mid-cut" alkyl (meth)acrylates), are 2-ethylhexyl acrylate (EHA), 2-ethylhexyl methacrylate, octyl methacrylate, nonyl methacrylate, decyl methacrylate, isodecyl methacrylate (IDMA, based on branched ($C_{10}$)alkyl isomer mixture), undecyl methacrylate, dodecyl methacrylate (also known as lauryl methacrylate), tridecyl methacrylate, tetradecyl methacrylate (also known as myristyl methacrylate), pentadecyl methacrylate and combinations thereof. Also useful are: dodecyl-pentadecyl methacrylate (DPMA), a mixture of linear and branched isomers of dodecyl, tridecyl, tetradecyl and pentadecyl methacrylates; decyl-octyl methacrylate (DOMA), a mixture of decyl and octyl methacrylates; nonyl-undecyl methacrylate (NUMA), a mixture of nonyl, decyl and undecyl methacrylates; and lauryl-myristyl methacrylate (LMA), a mixture of dodecyl and tetradecyl methacrylates.

Examples of the alkyl (meth)acrylate monomer where the alkyl group contains from 16 to 24 carbon atoms (also called the "high-cut" alkyl (meth)acrylates), are hexadecyl methacrylate (also known as cetyl methacrylate), heptadecyl methacrylate, octadecyl methacrylate (also known as stearyl methacrylate), nonadecyl methacrylate, eicosyl methacrylate, behenyl methacrylate and combinations thereof. Also useful are: cetyl-eicosyl methacrylate (CEMA), a mixture of hexadecyl, octadecyl, and eicosyl methacrylate; and cetyl-stearyl methacrylate (SMA), a mixture of hexadecyl and octadecyl methacrylate.

The mid-cut and high-cut alkyl (meth)acrylate monomers described above are generally prepared by standard esterification procedures using technical grades of long chain aliphatic alcohols, and these commercially available alcohols are mixtures of alcohols of varying chain lengths containing between about 10 and 15 or between about 16 and 20 carbon atoms in the alkyl group. Consequently, for the purposes of this invention, alkyl (meth)acrylate is intended to include not only the individual alkyl (meth) acrylate product named, but also to include mixtures of the alkyl (meth)acrylates with a predominant amount of the particular alkyl (meth)acrylate named. The use of these commercially available alcohol mixtures to prepare (meth) acrylate esters results in the DOMA, NUMA, LMA, DPMA, SMA and CEMA monomer types described above.

Typically, the amount of ($C_1$–$C_6$)alkyl (meth)acrylate monomer units in the first polymer [$P_1$] or the second polymer [$P_2$] is from zero to 15%, preferably from zero to less than 10% and more preferably from zero to less than 5%, based on total first polymer weight. When the ($C_1$–$C_6$) alkyl (meth)acrylate monomer units are based on ($C_1$–$C_2$) alkyl (meth)acrylate monomer, such as methyl methacrylate, typical amounts are less than 10% and preferably from zero to less than 5%. When the ($C_1$–$C_6$)alkyl (meth)acrylate monomer units are based on ($C_3$–$C_6$)alkyl (meth)acrylate monomer, such as butyl methacrylate or isobutyl methacrylate, typical amounts are less than 15% and preferably from zero to less than 10%.

Typically, the amount of ($C_7$–$C_{15}$)alkyl (meth)acrylate monomer units in the first polymer [$P_1$] is from 30 to 75%, preferably from 35 to less than 70% and more preferably from 40 to 65%, based on total first polymer weight. Typically, the amount of ($C_7$–$C_{15}$)alkyl (meth)acrylate monomer units in the second polymer [$P_2$] is from 75 to 100%, preferably from 80 to 97% and more preferably from 85 to 95%, based on total second polymer weight. Preferred ($C_7$–$C_{15}$)alkyl (meth)acrylate monomers useful in the preparation of [$P_1$] and [$P_2$] include, for example, isodecyl methacrylate, lauryl-myristyl methacrylate and dodecyl-pentadecyl methacrylate.

Typically, the amount of ($C_{16}$–$C_{24}$)alkyl (meth)acrylate monomer units in the first polymer [$P_1$] is from 25 to 70%, preferably from greater than 30 up to 65% and more preferably from 35 to 60%, based on total first polymer weight. Typically, the amount of ($C_{16}$–$C_{24}$)alkyl (meth) acrylate monomer units in the second polymer [$P_2$] is from zero to 25%, preferably from 3 to 20% and more preferably from 5 to 15%, based on total second polymer weight. Preferred ($C_{16}$–$C_{24}$)alkyl (meth)acrylate monomers useful in the preparation of [$P_1$] and [$P_2$] include, for example, cetyl-eicosyl methacrylate and cetyl-stearyl methacrylate.

Typically, the first and second polymers are combined in a weight ratio ([$P_1$]/[$P_2$]) of 5/95 to 75/25, preferably from 10/90 to 60/40 and more preferably from 15/85 to 50/50. Selected copolymers combined in the specified ratios of the present invention offer wider applicability in treatment of base oils from different sources when compared to the use of a single polymer additive or combinations of polymer additives having similar monomeric compositions or molecular weights. Particularly useful polymer compositions of the present invention include the first polymers [$P_1$] described above in combination with second polymers [$P_2$] having 90 to 100% ($C_7$–$C_{15}$)alkyl (meth)acrylate monomer units and zero to 10% ($C_{16}$–$C_{24}$)alkyl (meth)acrylate monomer units. The selected copolymer additive formulations of the present invention provide improved low temperature fluidity based on a combination of performance criteria (such as low-shear rate viscosity, yield stress and gel index) in a variety of lubricating oils heretofore not achievable.

Optionally, other monomers may be polymerized in combination with the alkyl (meth)acrylate monomers discussed above, for example acrylic acid, methacrylic acid, vinyl acetate, styrene, alkyl substituted (meth)acrylamides, monoethylenically unsaturated nitrogen-containing ring compounds, vinyl halides, vinyl nitriles and vinyl ethers. The amount of optional monomer used is typically zero to less than 10%, preferably zero to less than 5% and more preferably zero to less than 2%, based on total weight of monomers used. The optional monomers may be used as long they do not significantly affect the low temperature properties or the compatibility of the polymer additive with other lubricating oil composition components. The aforementioned discussion on use of optional monomers during the preparation of the alkyl (meth)acrylate polymers is also applicable to the other classes of polymers, such as vinylaromatic polymers, vinylaromatic-(meth)acrylic acid derivative copolymers, vinylaromatic-maleic acid derivative copolymers, vinyl alcohol ester-fumaric acid derivative copolymers, α-olefin-vinyl alcohol ester copolymers and α-olefin-maleic acid derivative copolymers.

Suitable monoethylenically unsaturated nitrogen-containing ring compounds include, for example, vinylpyridine, 2-methyl-5-vinylpyridine, 2-ethyl-5-vinylpyridine, 3-methyl-5-vinylpyridine, 2,3-dimethyl-5-vinylpyridine, 2-methyl-3-ethyl-5-vinylpyridine, methyl-substituted quinolines and isoquinolines, 1-vinylimidazole, 2-methyl-1-vinylimidazole, N-vinylcaprolactam, N-vinylbutyrolactam and N-vinylpyrrolidone.

Suitable vinyl halides include, for example, vinyl chloride, vinyl fluoride, vinyl bromide, vinylidene chloride, vinylidene fluoride and vinylidene bromide. Suitable vinyl nitrites include, for example, acrylonitrile and methacrylonitrile.

Well known bulk, emulsion or solution polymerization processes may be used to prepare the alkyl (meth)acrylate polymers useful in the present invention, including batch, semi-batch or semi-continuous methods. Typically, the polymers are prepared by solution (solvent) polymerization by mixing the selected monomers in the presence of a polymerization initiator, a diluent and optionally a chain transfer agent.

Generally, the temperature of the polymerization may be up to the boiling point of the system, for example, from about 60 to 150° C., preferably from 85 to 130° C. and more preferably from 110 to 120° C., although the polymerization can be conducted under pressure if higher temperatures are used. The polymerization (including monomer feed and hold times) is run generally for about 4 to 10 hours, preferably from 2 to 3 hours, or until the desired degree of polymerization has been reached, for example until at least 90%, preferably at least 95% and more preferably at least 97%, of the copolymerizable monomers has been converted to copolymer. As is recognized by those skilled in the art, the time and temperature of the reaction are dependent on the choice of initiator and target molecular weight and can be varied accordingly.

When the polymers are prepared by solvent (non-aqeuous) poymerizations, initiators suitable for use are any of the well known free-radical-producing compounds such as peroxy, hydroperoxy and azo initiators, including, for example, acetyl peroxide, benzoyl peroxide, lauroyl peroxide, tert-butyl peroxyisobutyrate, caproyl peroxide, cumene hydroperoxide, 1, 1-di(tert-butylperoxy)-3,3,5-trimethylcyclohexane, azobisisobutyronitrile and tert-butyl peroctoate (also known as tert-butylperoxy-2-ethylhexanoate). The initiator concentration is typically between 0.025 and 1%, preferably from 0.05 to 0.5%, more preferably from 0.1 to 0.4% and most preferably from 0.2 to 0.3%, by weight based on the total weight of the monomers. In addition to the initiator, one or more promoters may also be used. Suitable promoters include, for example, quaternary ammonium salts such as benzyl(hydrogenated-tallow)-dimethylammonium chloride and amines. Preferably the promoters are soluble in hydrocarbons. When used, these promoters are present at levels from about 1% to 50%, preferably from about 5% to 25%, based on total weight of initiator. Chain transfer agents may also be added to the polymerization reaction to control the molecular weight of the polymer. The preferred chain transfer agents are alkyl mercaptans such as lauryl mercaptan (also known as dodecyl mercaptan, DDM), and the concentration of chain transfer agent used is from zero to about 2%, preferably from zero to 1%, by weight.

When the polymerization is conducted as a solution polymerization using a solvent other than water, the reaction may be conducted at up to about 100% (where the polymer formed acts as its own solvent) or up to about 70%, preferably from 40 to 60%, by weight of polymerizable monomers based on the total reaction mixture. The solvents can be introduced into the reaction vessel as a heel charge, or can be fed into the reactor either as a separate feed stream or as a diluent for one of the other components being fed into the reactor.

Diluents may be added to the monomer mix or they may be added to the reactor along with the monomer feed. Diluents may also be used to provide a solvent heel, preferably non-reactive, for the polymerization, in which case they are added to the reactor before the monomer and initiator feeds are started to provide an appropriate volume of liquid in the reactor to promote good mixing of the monomer and initiator feeds, particularly in the early part of the polymerization. Preferably, materials selected as diluents should be substantially non-reactive towards the initiators or intermediates in the polymerization to minimize side reactions such as chain transfer and the like. The diluent may also be any polymeric material which acts as a solvent and is otherwise compatible with the monomers and polymerization ingredients being used.

Among the diluents suitable for use in the process of the present invention for non-aqueous solution polymerizations are aromatic hydrocarbons (such as benzene, toluene, xylene and aromatic naphthas), chlorinated hydrocarbons (such as ethylene dichloride, chlorobenzene and dichlorobenzene), esters (such as ethyl propionate or butyl acetate), ($C_6$–$C_{20}$) aliphatic hydrocarbons (such as cyclohexane, heptane and octane), mineral oils (such as paraffinic and naphthenic oils) or synthetic base oils (such as poly(α-olefin) oligomer (PAO) lubricating oils, for example, α-decene dimers, trimers and mixtures thereof). When the concentrate is directly blended into a lubricating base oil, the more preferred diluent is any mineral oil, such as 100 to 150 neutral oil (100N or 150N oil), which is compatible with the final lubricating base oil.

In the preparation of lubricating oil additive polymers, the resultant polymer solution, after the polymerization, generally has a polymer content of about 50 to 95% by weight. The polymer can be isolated and used directly in lubricating oil formulations or the polymer-diluent solution can be used in a concentrate form. When used in the concentrate form the polymer concentration can be adjusted to any desirable level with additional diluent. The preferred concentration of polymer in the concentrate is from 30 to 70% by weight and more preferably from 40 to 60%, with the remainder comprising a lubricating oil diluent.

When polymers useful by the process of the present invention are added to base oil fluids to improve low temperature fluidity, whether added as pure polymers or as concentrates, the final concentration of polymer in the formulated fluid is typically from 0.03 to 3%. For example, when a selected alkyl (meth)acrylate copolymer additive combination is used to maintain low temperature fluidity in lubricating oils the final concentration of the additive combination in the formulated fluid is typically from 0.03 to 3%, preferably from 0.05 to 2% and more preferably from 0.1 to 1%.

The base oil fluids used in formulating the improved lubricating oil compositions of the present invention include, for example, conventional base stocks selected from API (American Petroleum Institute) base stock categories known as Group I and Group II. The Group I and II base stocks are mineral oil materials (such as paraffinic and naphthenic oils) having a viscosity index (or VI) of less than 120; Group I is further differentiated from Group II in that the latter contains greater than 90% saturated materials and the former contains less than 90% saturated material (that is more than 10% unsaturated material). Viscosity Index is a measure of the degree of viscosity change as a function of temperature; high VI values indicate a smaller change in viscosity with temperature variation compared to low VI values. Improved lubricating oil compositions of the present invention involve the use of base stocks that are substantially of the API Group I and II type; the compositions may optionally contain minor amounts of other types of base stocks.

The improved lubricating oil compositions provided by the present invention contain from 0.1 to 20%, preferably from 1 to 15% and more preferably from 2 to 10%, based on total lubricating oil composition weight, of one or more auxiliary additives. Representative of these auxiliary additives are those found, for example, in dispersant-inhibitor (DI) packages of additives used by commercial lubricating oil formulators: an antiwear or antioxidant component, such as zinc dialkyl dithiophosphate; a nitrogen-containing ashless dispersant, such as polyisobutene based succinimide; a detergent additive, such as metal phenate or sulfonate; a friction modifier, such as a sulfur-containing organic; extreme pressure additives; corrosion inhibitors; and an antifoam agent, such as silicone fluid. Additional auxiliary additives include, for example, non-dispersant or dispersant viscosity index improvers.

The weight-average molecular weight ($M_w$) of polymers useful in the present invention may be from 10,000 to 1,500,000 and preferably from 10,000 to 1,000,000. In general, the lower molecular weight alkyl (meth)acrylate low temperature fluidity additives, [$P_2$], useful in the present invention have $M_w$ from 10,000 to 1,500,000, preferably from 10,000 to 1,000,000, more preferably from 10,000 to 500,000 and most preferably from 20,000 to 200,000 (as determined by gel permeation chromatography (GPC), using poly(alkylmethacrylate) standards). The higher molecular weight alkyl (meth)acrylate polymeric low temperature fluidity additives, [$P_1$], of the present invention have $M_w$ from 250,000 to 1,500,000, preferably from 250,000 to 1,000,000, more preferably from 300,000 to 800,000 and most preferably from 400,000 to 600,000. The weight average molecular weight of [$P_1$] is typically at least 50,000 greater than, preferably at least 100,000 greater than, and more preferably at least 200,000 greater than that of [$P_2$]. When the difference between $M_w$ values of [$P_1$] and [$P_2$] is less than about 50,000, the beneficial effect of combining [$P_1$] and [$P_2$] versus using each polymer individually is diminished with regard to satisfying simultaneously the low-shear rate viscosity, yield stress and gel index target properties of the treated oils.

Those skilled in the art will recognize that the molecular weights set forth throughout this specification are relative to the methods by which they are determined. For example, molecular weights determined by GPC and molecular weights calculated by other methods, may have different values.

The properties of low-shear rate viscosity, yield stress and gel index are more indicative measures of low temperature lubricant fluidity over longer time frames at slow cooling rates (extended use) than can be predicted from the ASTM pour point test (pour point is the lowest temperature at which the lubricant formulation remains fluid). The latter test (ASTM D 97) is of short duration of approximately one to two hours (from room temperature to lower temperature using a relatively rapid cooling rate of approximately 1° F./minute), whereas (1) the mini-rotary viscosity test (MRV TP-1, low-shear rate viscosity) involves slow cooling of the lubricating oil formulation at low temperatures using a cooling rate of about 0.3° C./hour to evaluate fluidity and yield stress, and (2) the Scanning Brookfield Technique (SBT) test involves measurements of gel index (proportional to rapid changes in viscosity) and the lowest temperature achievable for a specified viscosity target using cooling rates of 1° C./hour. The MRV TP-1 and SBT tests are used to estimate performance of lubricating oils for outdoor use under cold temperature conditions based on performance properties beyond the traditional "flow" or "no-flow" characteristics of the ASTM pour point test.

Pumpability of an oil at low temperatures, as measured by the mini-rotary viscometer (MRV), relates to viscosity under low-shear conditions at engine startup. Since the MRV test is a measure of pumpability, the engine oil must be fluid enough so that it can be pumped to all engine parts after engine startup to provide adequate lubrication. ASTM D-4684 deals with viscosity measurement in the temperature range of −10 to −40° C. and describes the MRV TP-1 test. SAE J300 Engine Oil Viscosity Classification (March 1997) allows a maximum of 60 pascal·seconds (Pa·sec) or 600 poise for formulated oils (at −40° C. for SAE 0W-XX, −35° C. for SAE 5W-XX, −30° C. for SAE 10W-XX, −25° C. for SAE 15W-XX, −20° C. for SAE 20W-XX, and −15° C. for SAE 25W-XX) using the ASTM D-4684 test procedure; preferably, the low-shear rate viscosity as measured by this test is less than 55 Pa·sec and more preferably less than 50 Pa·sec. Another aspect of low temperature performance measured by the MRV TP-1 test is yield stress (recorded in pascals); the target value for yield stress is "zero" pascals, although any value less than 35 pascals (limit of sensitivity of equipment) is recorded as "zero" yield stress. Yield stress values of greater than 35 pascals signify increasing degrees of less desirable performance.

Another measure of low temperature performance of lubricating oil compositions, referred to as Scanning Brookfield Technique (ASTM 5133), measures the lowest temperatures achievable by an oil formulation before the viscosity exceeds 30.0 Pa·sec (or 300 poise). Lubricating oil compositions having lower "30 Pa·sec temperature" values are expected to maintain their fluidity at low temperatures more readily than other compositions having higher "30 Pa·sec temperatures;" target value for SAE 5W-30 formulated oils is below about −30° C. Another aspect of low temperature performance measured by ASTM 5133 is the "gel index," based on a dimensionless scale (typically ranging from 3 to 100 units) that indicates the tendency of the lubricating oil composition to "gel" or "setup" as a function of a decreasing temperature profile at low temperature conditions; low gel index values indicate good low temperature fluidity with target values being less than about 8 to 12 units; the ILSAC (International Lubricant Standards and Acceptance Committee) specifications (GF-2) for SAE 5W-30 and SAE 10W-30 oils require gel index values to be less than 12 units.

For the purposes of the present invention, "maintaining low temperature fluidity" means that low-shear rate viscosity, yield stress (MRV TP-1 test) and gel index targets (SBT), as discussed above, are satisfied simultaneously by adding a combination of selected high and low molecular weight polymers to a lubricating oil composition. The method of the present invention provides improved low temperature fluidity by selecting and combining the first [$P_1$] and second [$P_2$] polymers in a weight ratio such that the lubricating oil composition has (a) a "gel index" of less than 12, preferably less than 10, more preferably less than 8.5, and most preferably less than 6; and (b) a "low-shear rate viscosity" of less than 60 Pa·sec, preferably less than 55 Pa·sec and more preferably less than 50 Pa·sec, with a "yield stress" of less than 35 pascals.

Example 1 provides general information for preparing polymers useful in the present invention; Example 2 provides properties of the untreated formulated oils used to evaluate polymers in lubricating oil compositions of the present invention; Example 3 summarizes composition and performance data on lubricating oil compositions containing the polymers (Tables 1, 1A, 1B and 2). All ratios, parts and percentages (%) are expressed by weight unless otherwise specified, and all reagents used are of good commercial quality unless otherwise specified.

Abbreviations used in the Examples and Tables are listed below with the corresponding descriptions; polymer additive compositions (#1–#14) are designated by the relative proportions of monomers used and polymers combined.

| | | |
|---|---|---|
| LMA = | Lauryl-Myristyl Methacrylate Mixture | |
| DPMA = | Dodecyl-Pentadecyl Methacrylate Mixture | |
| SMA = | Cetyl-Stearyl Methacrylate Mixture | |
| CEMA = | Cetyl-Eicosyl Methacrylate Mixture | |
| DDM = | Dodecyl Mercaptan | |
| SBT = | Scanning Brookfield Technique | |
| NM = | Not Measured | |
| 1 = | 70/30 LMA/CEMA | $M_w$ = 582,000 |
| 2 = | 70/30 LMA/CEMA | $M_w$ = 122,000 |
| 3 = | 94/6 LMA/SMA | $M_w$ = 73,400 |
| 4 = | 94/6 LMA/SMA | $M_w$ = 1,180,000 |
| 5 = | 50/50 #2/#3 | |
| 6 = | 50/50 #1/#3 | |
| 7 = | 50/50 #1/#4 | |
| 8 = | 50/50 #3/#4 | |
| 9 = | 50/50 #2/#4 | |
| 10 = | 50/50 #1/#2 | |
| 11 = | 65 LMA/35 SMA | $M_w$ = 635,000 |
| 12 = | 85 DPMA/15 CEMA | $M_w$ = 92,000 |
| 13 = | 14/86 #11/#3 | |
| 14 = | 37/63 #11/#12 | |

EXAMPLE 1

Preparation of [$P_1$] and [$P_2$] Polymers

Typically, the individual [$P_1$] and [$P_2$] polymers were prepared according to the following description, representative of a conventional solution polymerization process with appropriate adjustments for desired polymer composition and molecular weight. A monomer mix was prepared containing 131 to 762 parts of CEMA or SMA (6–35%), 1416 to 2047 parts of LMA or DPMA (65–94%), 2.9 parts of tert-butyl peroctoate solution (50% in odorless mineral spirits) and about 9 to 13 parts of DDM. Sixty percent of this mix, 1316 parts, was charged to a nitrogen-flushed reactor. The reactor was heated to a desired polymerization temperature of 110° C. and the remainder of the monomer mix was fed to the reactor at a uniform rate over 60 minutes. Upon completion of the monomer feed the reactor contents were held at 110° C. for an additional 30 min., then 5.9 parts of tert-butyl peroctoate solution (50% in odorless mineral spirits) dissolved in 312 parts of 100N polymerization oil were fed to the reactor at a uniform rate over 60 min. The reactor contents were held for 30 min. at 110° C. and then diluted with 980 parts of 100N polymerization oil. The reaction solution was stirred for an additional 30 min. and then transferred from the reactor. The resultant solution contained approximately 60% polymer solids which represented approximately 98% conversion of monomer to polymer.

The individual polymers [$P_1$] and [$P_2$] prepared as above were then evaluated separately or combined in various ratios for low temperature performance evaluations.

EXAMPLE 2

Untreated Formulated Oil Properties

The properties of untreated commercial formulated oils (without low temperature fluidity additive, but including DI package and VI improver additive) used to evaluate the low temperature fluidity additives of the present invention are presented below: pour point according to ASTM D 97 (indicates ability to remain fluid at very low temperatures and is designated as the lowest temperature at which the oil remains fluid), viscosity index (VI), kinematic and dynamic (ASTM D 5293) bulk viscosity properties.

| | Formulated* Oil A | Formulated* Oil B | Formulated* Oil C |
|---|---|---|---|
| Kinematic Viscosity: | | | |
| 100° C. ($10^6$ $m^2$/sec) | 10.23 | 9.99 | 13.39 |
| 40° C. ($10^6$ $m^2$/sec) | 60.84 | 60.31 | 94.31 |
| SAE Grade | 5W-30 | 5W-30 | 10W-40 |
| Viscosity Index | 156 | 152 | 141 |
| ASTM D 97, Temp (° C.) | −12 | −15 | −15 |
| ASTM D 5293 | | | |
| Temperature (° C.) | −25 | −25 | −20 |
| Viscosity (Pa · s ec) | 3.18 | 3.52 | 3.39 |

*without low temperature fluidity additive, includes DI package and VI improver additive

EXAMPLE 3

Low Temperature Performance Properties

Tables 1, 1A, 1B and 2 present data indicative of low temperature pumpability performance for polymeric additive combinations useful in the present invention in comparison with the individual polymer additives and combinations of additives outside the scope of the present invention. The data in the tables are Treat Rate (weight % of polymer additive in formulated oil) and the corresponding low-shear rate viscosities, yield stress (at −30° C. or −35° C.) and gel index values in different formulated oils. Low-shear rate viscosities (below 60 Pa·sec), "zero" pascal yield stress values and gel index values below 12 represent the minimum acceptable target properties.

TABLE 1

Effect of [$P_1$] and [$P_2$] Combinations on Low Temperature Properties in Formulated Oil A

| | | Low-Shear Rate Viscosity (MRV TP-1) | | |
|---|---|---|---|---|
| ID # | Treat Rate | −35° C. Viscosity (Pa · s ec) | −35° C. Yield Stress, Pa | SBT (ASTM D 5133) Gel Index |
| Oil A | 0.00 | 254.3 | 240 | 42.3 |
| 1 | 0.06 | 58.0 | 0 | 6.4 |
| 2 | 0.06 | 85.0 | 105 | 5.3 |
| 3 | 0.06 | 46.3 | 0 | 38.8 |
| 4 | 0.06 | 86.9 | 35 | NM |
| 5 | 0.03/0.03 | 64.5 | 35 | 5.1 |
| 6 | 0.03/0.03 | 56.8 | 0 | 5.2 |
| 7 | 0.03/0.03 | 57.2 | 0 | 5.1 |
| 8 | 0.03/0.03 | 86.5 | 35 | 39.6 |
| 9 | 0.03/0.03 | 61.0 | 70 | 5.2 |
| 10 | 0.03/0.03 | 68.0 | 0 | 5.0 |
| 14 | 0.022/0.038 | 58.8 | 0 | 5.3 |

TABLE 1A

Effect of $[P_1]$ and $[P_2]$ Combinations on Low Temperature Properties in Formulated Oil B

| ID # | Treat Rate | Low-Shear Rate Viscosity (MRV TP-1) −35° C. Viscosity (Pa · s ec) | −35° C. Yield Stress, Pa | SBT (ASTM D 5133) Gel Index |
|---|---|---|---|---|
| Oil B | 0.00 | 81.4 | 35 | 10.3 |
| 13 | 0.016/0.096 | 36.9 | 0 | 4.6 |
| 13 | 0.012/0.072 | 36.1 | 0 | 4.5 |
| 13 | 0.008/0.05 | 38.9 | 0 | 5.2 |
| 13 | 0.004/0.025 | 42.8 | 0 | 5.3 |

TABLE 1B

Effect of $[P_1]$ and $[P_2]$ Combinations on Low Temperature Properties in Formulated Oil C

| ID # | Treat Rate | Low-Shear Rate Viscosity (MRV TP-1) −30° C. Viscosity (Pa · s ec) | −30° C. Yield Stress, Pa | SBT (ASTM D 5133) Gel Index |
|---|---|---|---|---|
| Oil C | 0.00 | 84.8 | 70 | 13.6 |
| 13 | 0.016/0.096 | 39.4 | 0 | 4.6 |
| 13 | 0.012/0.072 | 38.5 | 0 | 5.9 |
| 13 | 0.008/0.05 | 39.4 | 0 | 5.5 |
| 13 | 0.004/0.025 | 48.7 | 0 | 10.2 |

TABLE 2

Effect of $[P_1]$ and $[P_2]$ Ratio on Low Temperature Properties in Formulated Oil A

| $[P_1]/[P_2]$* | Treat Rate | Low-Shear Rate Viscosity (MRV TP-1) −35° C. Viscosity (Pa · s ec) | −35° C. Yield Stress, Pa | SBT (ASTM D 5133) Gel Index |
|---|---|---|---|---|
| Oil A | 0.00 | 254.3 | 240 | 42.3 |
| 80/20 | 0.048/0.012 | 68.2 | 0 | 4.9 |
| 60/40 | 0.036/0.024 | 59.8 | 0 | 5.1 |
| 50/50 | 0.03/0.03 | 56.8 | 0 | 5.2 |
| 40/60 | 0.024/0.036 | 59.5 | 0 | 5.1 |
| 30/70 | 0.018/0.042 | 60.9 | 0 | 4.2 |
| 20/80 | 0.012/0.048 | 51.4 | 0 | 4.2 |

*$[P_1]$ = #1, $[P_2]$ = #3

The following discussion is based on the data in Tables 1, 1A and 1B. Combinations of polymers having similar molecular weights (#5) or similar compositions (#8 and #10) are ineffective in providing a satisfactory combination of low temperature fluidity properties. Combinations of polymers having different $M_w$ giving an intermediate $M_w$ provide a satisfactory combination of low temperature fluidity properties when the combination (#6, #13 and #14) is made up of a higher $M_w$ polymer having a higher ($C_{16}$–$C_{24}$) content (such as #1 or #11) with a lower $M_w$ polymer having a lower ($C_{16}$–$C_{24}$) content (such as #3 or #12). These data support the discovery that the best combination of low temperature fluidity performance properties occurs when the higher $M_w$ polymer has the higher ($C_{16}$–$C_{24}$) content range and the lower $M_w$ polymer has the lower ($C_{16}$–$C_{24}$) content range.

We claim:

1. A method for maintaining low temperature fluidity of a lubricating oil composition comprising adding from 0.03 to 3 percent, based on total lubricating oil composition weight, of a first $[P_1]$ and a second $[P_2]$ polymer to the lubricating oil composition wherein:

(a) the first polymer $[P_1]$ comprises zero to 15 percent monomer units selected from one or more ($C_1$–$C_6$)alkyl (meth)acrylates, 30 to 75 percent monomer units selected from one or more ($C_7$–$C_{15}$)alkyl (meth) acrylates and 25 to 70 percent monomer units selected from one or more ($C_{16}$–$C_{24}$)alkyl (meth)acrylates, based on total first polymer weight, and has a weight average molecular weight from 250,000 to 1,500,000;

(b) the second polymer $[P_2]$ comprises zero to 15 percent monomer units selected from one or more ($C_1$–$C_6$)alkyl (meth)acrylates, 75 to 100 percent monomer units selected from one or more ($C_7$–$C_{15}$)alkyl (meth) acrylates and zero to 25 percent monomer units selected from one or more ($C_{16}$–$C_{24}$)alkyl (meth) acrylates, based on total second polymer weight, and has a weight average molecular weight from 10,000 to 1,500,000;

(c) the first polymer $[P_1]$ has a weight average molecular weight at least 50,000 greater than that of the second polymer $[P_2]$; and (d) the first and second polymers are combined in a weight ratio ($[P_1]/[P_2]$) of 5/95 to 75/25.

2. The method of claim 1 wherein the first $[P_1]$ and second $[P_2]$ polymers are selected and combined in a weight ratio such that the lubricating oil composition has:

(a) a "gel index" of less than 12, and (b) a "low-shear rate viscosity" of less than 60 pascal·seconds with a "yield stress" of less than 35 pascals.

3. The method of claim 2 wherein the "gel index" is less than 8.5 and the "low-shear rate viscosity" is less than 55 pascal·seconds.

4. The method of claim 1 wherein the first polymer $[P_1]$ has a weight average molecular weight from 300,000 to 800,000, and the second polymer $[P_2]$ has a weight average molecular weight from 20,000 to 200,000.

5. The method of claim 1 wherein:

(a) the first polymer $[P_1]$ comprises 35 to less than 70 percent monomer units selected from one or more ($C_7$–$C_{15}$)alkyl (meth)acrylates and greater than 30 up to 65 percent monomer units selected from one or more ($C_{16}$–$C_{24}$)alkyl (meth)acrylates; and (b) the second polymer $[P_2]$ comprises 85 to 95 percent monomer units selected from one or more ($C_7$–$C_{15}$) alkyl (meth)acrylates and 5 to 15 percent monomer units selected from one or more ($C_{16}$–$C_{24}$)alkyl (meth) acrylates.

6. The method of claim 1 wherein the ($C_7$–$C_{15}$)alkyl (meth)acrylate of the first $[P_1]$ and second polymer $[P_2]$ is selected from one or more of isodecyl methacrylate, dodecyl-pentadecyl methacrylate, nonyl-undecyl methacrylate and lauryl-myristyl methacrylate; and the ($C_{16}$–$C_{24}$) alkyl (meth)acrylate of the first $[P_1]$ and second polymer $[P_2]$ is selected from one or more of cetyl-eicosyl methacrylate and cetyl-stearyl methacrylate.

7. A method for maintaining low temperature fluidity of a lubricating oil composition comprising adding from 0.03 to 3 percent, based on total lubricating oil composition weight, of a first $[P_1]$ and a second $[P_2]$ polymer to the lubricating oil composition wherein:

(a) the first polymer [$P_1$] comprises monomer units selected from one or more of vinylaromatic monomers, α-olefins, vinyl alcohol esters, (meth)acrylic acid derivatives, maleic acid derivatives and fumaric acid derivatives, and has a weight average molecular weight from 250,000 to 1,500,000;

(b) the second polymer [$P_2$] comprises monomer units selected from one or more of vinylaromatic monomers, α-olefins, vinyl alcohol esters, (meth)acrylic acid derivatives, maleic acid derivatives and fumaric acid derivatives, and has a weight average molecular weight from 10,000 to 1,500,000;

(c) the first polymer [$P_1$] has a weight average molecular weight at least 50,000 greater than that of the second polymer [$P_2$]; and (d) the first and second polymers are combined in a weight ratio ([$P_1$]/[$P_2$]) of 5/95 to 75/25.

8. The method of claim 7 wherein the first [$P_1$] and second [$P_2$] polymers are selected from one or more of vinylaromatic-(meth)acrylic acid derivative copolymers, vinylaromatic-maleic acid derivative copolymers, vinyl alcohol ester-fumaric acid derivative copolymers, α-olefin-vinyl alcohol ester copolymers, α-olefin-maleic acid derivative copolymers and α-olefin-fumaric acid derivative copolymers.

9. A lubricating oil composition comprising a lubricating oil and from 0.03 to 3 percent, based on weight of the lubricating oil composition, of a first [$P_1$] and a second [$P_2$] polymer wherein:

(a) the first polymer [$P_1$] comprises zero to 15 percent monomer units selected from one or more ($C_1$–$C_6$)alkyl (meth)acrylates, 30 to 75 percent monomer units selected from one or more ($C_7$–$C_{15}$)alkyl (meth) acrylates and 25 to 70 percent monomer units, selected from one or more ($C_{16}$–$C_{24}$)alkyl (meth)acrylates, based on total first polymer weight, and has a weight average molecular weight from 250,000 to 1,500,000;

(b) the second polymer [$P_2$] comprises zero to 15 percent monomer units selected from one or more ($C_1$–$C_6$)alkyl (meth)acrylates, 90 to 100 percent monomer units selected from one or more ($C_7$–$C_{15}$)alkyl (meth) acrylates and zero to 10 percent monomer units selected from one or more ($C_{16}$–$C_{24}$)alkyl (meth) acrylates, based on total second polymer weight, and has a weight average molecular weight from 10,000 to 1,500,000;

(c) the first polymer [$P_1$] has a weight average molecular weight at least 50,000 greater than that of the second polymer [$P_2$];

(d) the first and second polymers are combined in a weight ratio ([$P_1$]/[$P_2$]) of 5/95 to 75/25;

(e) the lubricating oil comprises a base fluid selected from one or more of API Group I and Group II base stocks; and (f) the lubricating oil composition comprises from 0.1 to 20 percent, based on total lubricating oil composition weight, of auxiliary additives selected from one or more viscosity index improvers, antiwear agents, antioxidants, dispersants, detergents, friction modifiers, antifoam agents, extreme pressure additives and corrosion inhibitors.

* * * * *

UNITED STATES PATENT AND TRADEMARK OFFICE

CERTIFICATE OF CORRECTION

PATENT NO. : 6,458,749 B2
DATED : October 1, 2002
INVENTOR(S) : Kinker et al.

It is certified that error appears in the above-identified patent and that said Letters Patent is hereby corrected as shown below:

Title page, Item [54] and Column 1, lines 1-5,
Should read:

-- METHOD FOR IMPROVING LOW-TEMPERATURE FLUIDITY OF LUBRICATING OILS USING HIGH-AND LOW-MOLECULAR WEIGHT POLYMER ADDITIVE MIXTURES --

Signed and Sealed this

Twenty-first Day of January, 2003

JAMES E. ROGAN
*Director of the United States Patent and Trademark Office*